US005086954A

United States Patent [19]

Brody

[11] Patent Number: 5,086,954

[45] Date of Patent: Feb. 11, 1992

[54] SPRAY CAN ACTUATION DEVICE WITH IMPROVED CAN RETENTION

[75] Inventor: Harvey Brody, Costa Mesa, Calif.

[73] Assignee: Delshar Industries, Inc., Santa Ana, Calif.

[21] Appl. No.: 680,818

[22] Filed: Apr. 4, 1991

[51] Int. Cl.[5] ..... B65D 83/14

[52] U.S. Cl. ..... 222/402.11; 222/402.15; 222/474

[58] Field of Search ..... 222/153, 174, 182, 321, 222/323, 402.11–402.15, 472–475, 509; 239/DIG. 22, 526, 578

[56] References Cited

U.S. PATENT DOCUMENTS

| | | | |
|---|---|---|---|
| 2,877,934 | 3/1959 | Wallace | 222/472 X |
| 3,172,582 | 3/1965 | Belpedio | 222/473 X |
| 3,506,159 | 4/1970 | Müller | 222/473 X |
| 3,865,283 | 2/1975 | Hayes | 222/402.11 |
| 3,937,368 | 2/1976 | Hoagland | 222/402.11 |
| 4,432,474 | 2/1984 | Hutchinson et al. | 222/473 X |
| 4,449,647 | 5/1984 | Reed et al. | 222/473 X |
| 4,505,335 | 3/1985 | Hayba | 222/473 X |
| 4,805,812 | 2/1989 | Brody | 222/402.15 X |

*Primary Examiner*—Michael S. Huppert
*Assistant Examiner*—Kenneth DeRosa
*Attorney, Agent, or Firm*—Klein & Szekeres

[57] ABSTRACT

A spray can actuation device includes a body that is removably attachable to the top of a spray can. The body includes a handle and a valve actuation lever, operated by a trigger, that engages the push-button valve on the can when the trigger is pressed. A locking plate is pivotally attached to the forward portion of the body for movement between an unlocked position, in which the actuation lever is allowed to engage the valve, and a locked position, in which the lever is locked out of engagement with the valve. The forward portion of the body includes a rim that is engageable with the channel that typically surrounds the valve on such spray cans. The rim is formed by a pair of rim halves, each with a thin-walled flexure point, and joined at the front by an interlocking connection, preferably a pin-and-socket joint. During the insertion of the rim into the channel, the rim resiliently flexes at the flexure points, while the interlocking connection substantially prevents relative movement between the rim halves, thereby facilitating the attachment of the device to the can, and making the attachment more secure.

13 Claims, 1 Drawing Sheet

SPRAY CAN ACTUATION DEVICE WITH IMPROVED CAN RETENTION

BACKGROUND OF THE INVENTION

The present invention relates to a device for both holding a pressurized container, such as a spray can, and for actuating the valve of the container to dispense its pressurized contents. More particularly, the present invention relates to an improvement in such devices, whereby these devices can remain attached to a spray can with much reduced risk of an inadvertent actuation of the valve.

Spray can holding and actuation devices are well known in the art, as exemplified by the following U.S. Pat. Nos. 2,877,934 to Wallace; 3,172,582 to Belpedio; 3,189,232 to Joffe; and 4,089,440 to Lee. Further examples of such actuation devices are disclosed in the following British patent specifications; 1,163,978; 1,343,881; 1,487,719; 2,001,706 (published application); and 2,038,952 (published application).

Of the prior art spray can actuation devices, one of the more popular types has the general configuration of a pistol, as particularly exemplified in U.S. Pat. No. 4,805,812 to Brody, and U.S. Pat. No. 4,432,474 to Hutchinson et al. These pistol-shaped devices typically include a body that has a pistol-grip handle, and means on the front of the body for removable attachment to the top of a spray can, of the type having a push-button valve. The body carries a valve actuation member that is operably linked or connected to a trigger, the latter being situated with respect to the handle in a manner similar to the trigger of a pistol. The linkage between the actuation member and the trigger is such that when the trigger is squeezed or depressed, the actuation member is brought into operable engagement with the push-button valve, thereby actuating the valve to dispense the contents of the container.

The device disclosed in the Brody patent adds to this basic structure a mechanism for disabling or locking the pushbutton actuation mechanism. This locking mechanism comprises a locking plate having a portion pivotally connected to the body of the device adjacent to the attachment means, the plate having a notch dimensioned to receive the valve actuation member. The plate is pivotable between a first position in which it is out of the path of travel between the valve actuation member and the push-button valve, and a second position wherein the valve actuation member is received in the notch so as to be restrained from moving into engagement with the valve.

While the prior art spray can devices have added greatly to the convenience and safety of using spray cans, their widespread use has revealed the desirability of further improvements and refinements. For example, while devices constructed in accordance with the above-mentioned U.S. Pat. No. 4,805,812 to Brody have achieved great commercial success, it is felt that further improvements in the can retention and valve actuation functions would enhance their appeal and utility to the user.

Summary of the Invention

Broadly, the present invention is an improved spray can actuation device, of the type exemplified by the above-mentioned Brody patent, wherein the major improvement comprises a can retention lip or rim that is configured for easier and more positive engagement with the channel surrounding the pushbutton valve on a spray can. More specifically, the lip or rim is configured with relatively thick front and back portions, connected by side wall portions having flexure points, so as to be resiliently flexible. The front portion is provided with a pin-and-socket arrangement that gives increased rigidity to the front portion, so that when the rim is inserted into the can channel, front portion first, the front portion substantially maintains its shape and integrity while the side portions flex at the flexure points to allow the back portion to be inserted into the channel. By maintaining the rigidity of the front portion, while increasing the flexibility of the side wall portions, a more positive and secure locking engagement between the rim and the channel is achieved.

In a specific preferred embodiment of the invention, other improvements are incorporated. For example, the present invention includes a valve actuation lever having a broadened surface on its free end for a more positive engagement with the push-button valve on the can. The device also includes a pivoting actuation lever locking plate, as in the aforementioned Brody patent, but the device is provided with a support structure that provides enhanced support of the plate when it is in its locked position.

The present invention thus provides a number of enhancements that are easily incorporated into existing spray can actuation devices, of the type generally disclosed in the aforementioned Brody patent.

Brief Description of the Drawings

Referring now to the drawings, FIGS. 1, 2 and 3 show an improved actuation and holding device 10, in accordance with the preferred embodiment of the present invention, attached to a pressurized container 12, having a push-button spray valve 13. The actuation and holding device 10 has a body 14 that would typically be made of molded plastic by conventional techniques, well-known in the art, such as the "butterfly" molding method. The body 14 includes a pistol grip handle 16 and a forward portion 18 that extends in a generally downward direction, terminating in a generally annular shoulder 20. interrupted in the front by a gap, as best shown in FIG. 2. Extending downwardly from the shoulder 20 is an annular extension 22 that terminates in an annular rim or lip 24. As best shown in FIG. 3, the rim 24 is dimensioned to be received in an annular channel 25 formed in the top of the pressurized container 12, around the push-button valve 13. The rim 24 thus provides means from removably attaching the device 10 to the container 12.

As shown in FIG. 4, the rim 24 includes a front portion 26 and a back portion 27, joined by a pair of opposed side wall portions 28. The front and back portions are relatively thick and inflexible, while each of the side wall portions has a relatively thin, resiliently flexible integral hinge or flexure point 28*a*, approximately mid way between the front and back portions.

Figure 3:
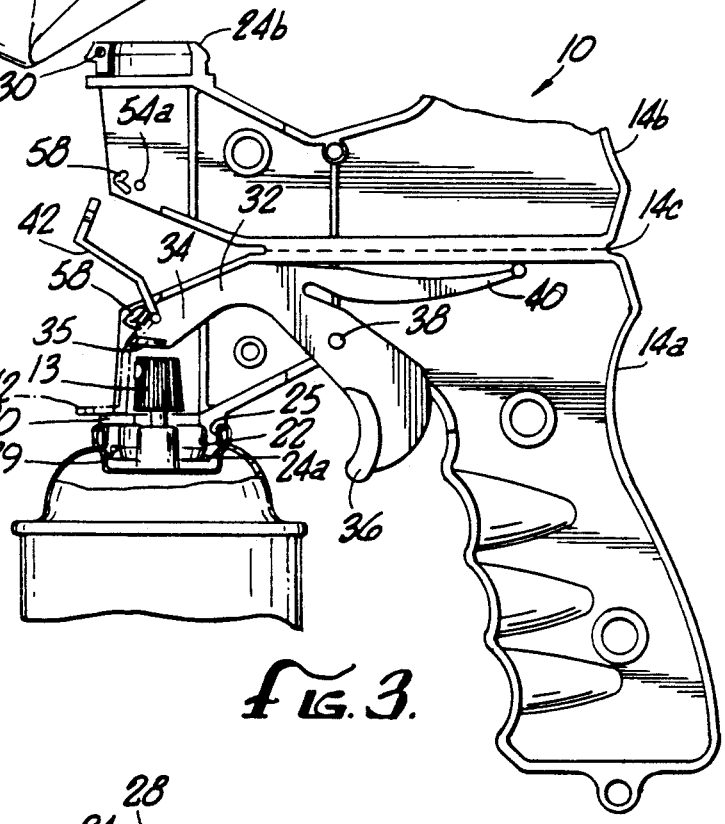
FIG. 3 is a cross-sectional view of the preferred embodiment attached to the can, showing the two butterflymolded sections of the device before they are folded together.

When the device is formed by the butterfly molding method, the body 14 is initially formed in two axial or longitudinal halves 14*a* and 14*b*, joined along a longitudinal hinge 14*c*, as shown in FIG. 3. The rim 24 is therefore also longitudinally divided into first and second halves 24*a* and 24*b*, respectively The front portion of the first rim half 24*a* has a laterallyextending pin 29, while the front portion of the second rim half 24*b* has a socket 30 that receives the pin 29 when the two body halves are folded together along the hinge 14*c*.

The mating of the pin 29 and the socket 30 creates a reinforcement for the front portion 26 of the rim 24, while substantially preventing relative movement of the rim halves during insertion. Because of the resulting increased rigidity of the front portion 26, the front portion maintains its shape and integrity when the rim is inserted into the can channel 25, front portion first, while the side portions 28 are flexed at the flexure points 28*a* to bring the back portion 27 of the rim into the channel 25. The frontal gap in the shoulder 20 facilitates the movement of the front portion 26 toward the back portion 27, while assuring flexure at the flexure points 28*a*. By thus maintaining the rigidity and structural integrity of the front portion of the rim while increasing the flexibility of the side portions, the rim can be more securely locked into the channel, as compared with those devices that lack this type of rim configuration.

The front of the body 14 above the shoulder 20 is provided with an opening 31, through which the contents of the container 12 are dispensed from the valve 13. The opening 31 is substantially rectangular in outline and is defined on the bottom by the shoulder 20, and on the sides and top by the wall surface of the forward portion 18 of the body.

As best shown in FIG. 3, the device 10 includes a valve actuation member comprising a lever 32 disposed longitudinally within the body. The lever 32 has a first or free end 34 which extends through the forward portion 18 of the body and into the opening 31, thereby being disposed just above the valve 13. The free end 34 terminates in a laterally-extended surface in the form of a flattened disk 35 that provides a flat, substantially circular surface for effecting a positive engagement with the valve, as described below. The other end of the lever extends through an opening in the underside of the body and is configured in the shape of a trigger 36. The actuation lever 32 pivots on a pin 38 when the trigger 36 is pressed toward the handle 16, thereby causing the free end 34 to pivot downwardly to bring the disk 35 into operative engagement against valve 13. In this manner, the valve 13 is depressed to dispense the contents of the container. The actuation lever 32 may include a resilient, rearwardly-extending extension 40 that engages an interior surface of the body, and that acts as a spring to assist the return of the lever to its original position when the trigger 36 is released. In this original position, the free end 34 of the lever is out of engagement with the valve 13, as shown in FIG. 3.

Figure 5:
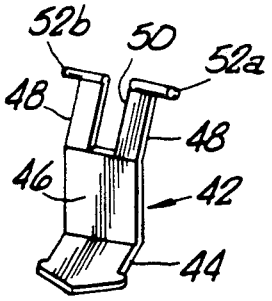
FIG. 5 is a front perspective view of the locking plate used in the preferred embodiment of the invention.
Figure 4:
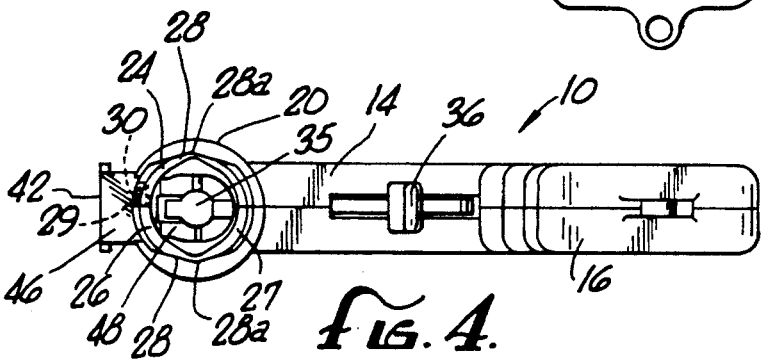
FIG. 4 is a bottom plan view of the preferred embodiment of the invention.

In accordance with the preferred embodiment of the present invention, actuation lever locking means are provided for selectively locking the valve actuation lever 32 in a position disengaged from the valve 13. This locking means includes a locking plate 42. As best shown in FIG. 5, the locking plate 42 includes a substantially horizontal base portion 44, an intermediate portion 46 joined to the base portion 44 at a slightly obtuse angle, and upper portion 48 joined to the intermediate portion 46 at an obtuse angle. The upper portion 48 is bifurcated by a slot 50. The upper edge of the upper portion 48 is provided with a pair of outwardly extending ears or pivot pins 52*a* and 52*b*, of different diameters, that are registrable and engageable with a pair of similarly-sized apertures in the two opposed side walls of the forward portion 18 of the body, on opposite sides of the opening 31. (Only one of the apertures, labelled 54*a*, is shown in FIG. 3.) The assymetrical sizes of the pivot pins 52*a* and 52*b*, and their associated apertures facilitate the proper orientation of the plate 42 during assembly.

Figure 1:
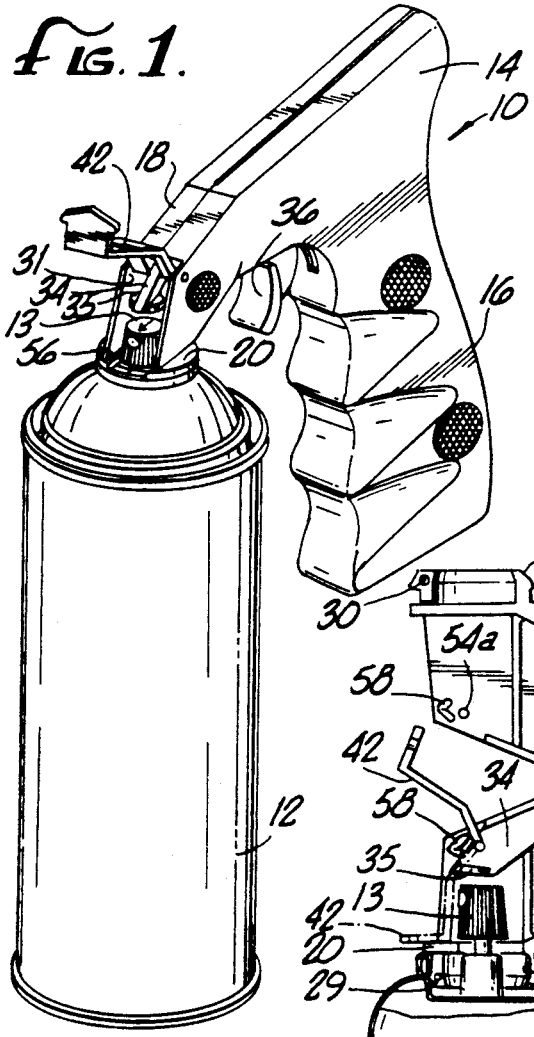
FIG. 1 is a perspective view of a spray can actuation and holding device, in accordance with a preferred embodiment of the present invention, showing the device attached to a pressurized spray can.
Figure 2:
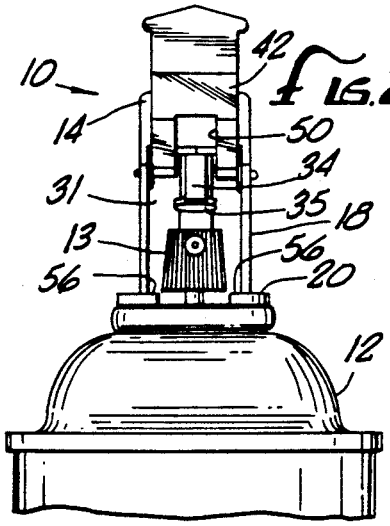
FIG. 2 is a front elevational view of the embodiment of FIG. 1, showing the device attached to the can.

With the pins 52*a* and 52*b* engaged in their associated apertures, the plate 42 is mounted for pivotal movement in a substantially vertical plane into and out of the opening 31. When the plate 42 is pivoted upwardly out of the opening 31 (as shown in solid outline in FIG. 3), it is in an unlocked position, wherein the disk 35 on the free end 34 of the actuation lever 32 is allowed to come into operable engagement with the push-button valve 13 when the trigger 36 is pressed. When the plate 42 is pivoted downwardly into the opening 31 (as shown in phantom outline in FIG. 3), it is in a locked position, in which the free end 34 of the actuation lever 32 is received in the notch 50 and is thereby restrained from further movement In this manner, the actuation lever 32 is locked in a position with its free end 34 disengaged from the valve 13. When the plate 42 is in the locked position, its base 44 rests on a pair of parallel, longitudinal rails 56, best shown in FIG. 2 as being formed on the interior surfaces of the forward portion 18 of the body 14, substantially coplanar with the shoulder 20. This support for the base 44 provides a secure locking of the actuation lever 32, and a high degree of reliability in operation.

An advantageous feature of the above described locking mechanism is that when the plate 42 is moved downwardly, it acts as a shield to block the spray from the valve 13, should the free end 34 of the actuation lever 32 somehow fail to be received in the notch 50.

The device 10 is also provided with a pair of inwardlyextending projections or detents, 58 as shown in FIG. 3, formed on the interior surfaces of the opposed side walls of the forward portion 18 of the body 14, adjacent the pivot pin apertures. These detents are dimensioned so as to provide a slight frictional engagement between the detents 58 and the sides of the plate 42. This frictional engagement requires the application of a slight pressure to urge the locking plate downward to its locked position, and upward to its unlocked position, thereby providing a detent mechanism that substantially reduces the likelihood that the locking plate will inadvertently move from its unlocked position to its locked position or from its locked position to its unlocked position.

From the foregoing description, it can be seen that the present invention offers several distinct advantages over the current state of the art, as exemplified by the above-described Brody patent. For example, a more secure attachment of the actuation and holding device to the can is achieved by the pin-and-socket mechanism 29, 30, while a more positive engagement between the actuation lever 32 and the valve 13 is achieved by means of the disk 35 on the free end 34 of the lever.

Although a preferred embodiment has been described herein, variations and modifications of this embodiment will suggest themselves to those skilled in the pertinent arts. For example, a number of equivalents may be found to the pin-and-socket arrangement 29, 30 for providing an interlocking engagement between the halves of the rim 24, whereby rigidity at the front portion thereof is maintained in response to the forces applied during the attachment of the device to a can. A tongue-and-groove configuration, for example, may be found suitable. The valve engagement member 35 need not be diskshaped, as described herein; rather, it can be a planar surface having any number of configurations. These and other variations of the above-described embodiment are considered within the spirit and scope of the present invention.

What is claimed is:

1. An actuation device for holding a pressurized container and actuating a push button valve in the top of the container to dispense the pressurized contents thereof, the container having an annular channel around the valve, the device having a body including a forward portion adapted for removable attachment to the container, an actuation member in the forward portion of the body, engageable with the push button valve for actuation of the valve, and trigger means, operatively connected to the actuation member, and operable to bring the actuation member into operable engagement with the valve, wherein the improvement comprises:

attachment means, on the forward portion of the body, for removably attaching the forward portion to the container, the attachment means comprising:

a substantially annular rim dimensioned to be received in the channel surrounding the valve, the rim being divided into first and second substantially semicircular halves joined at front and back junctures forming front and back rim portions, respectively, each of the rim halves having a side wall portion with flexure means for allowing the side wall to flex resiliently in response to forces applied to the front portion when the rim is inserted into the channel, front portion first; and interlocking means for joining the first and second rim halves at the front portion of the rim so as to limit substantial relative movement between the rim halves as the rim is inserted into the channel.

2. The actuation device of claim 1, wherein the interlocking means comprises a pin-and-socket assembly at the front portion of the rim, the pin-and-socket assembly comprising:

a pin extending from the first rim half toward the second rim half; and a socket in the second rim half, dimensioned and oriented so as to receive the pin.

3. The actuation device of claim 1, wherein the flexure means comprises:

a reduced-thickness area in the side wall portion of each of the rim halves, the reduced thickness area thereby forming a flexure point in each of the rim halves at which the rim half is resiliently flexible.

4. The actuation device of claim 1, wherein the actuation member has a free end, and wherein the improvement further comprises:

a valve engagement member on the free end, having a laterally-extended planar surface for engagement with the valve.

5. The actuation device of claim 4, wherein the valve engagement member is substantially in the form of a disk.

6. The actuation device of claim 1, wherein the forward portion of the body has two opposing side walls, and wherein the device further comprises a plate having a portion pivotally connected to the forward portion of the body between the two opposed side walls thereof, the plate having a notch dimensioned to receive a portion of the actuation member, the plate being pivotable between a first position wherein it is out of the path of travel between the actuation member and the valve, and a second position wherein the actuation member portion is received in the notch so as to be restrained from moving into engagement with the valve, and wherein the improvement further comprises:

a first pivot pin pivotally connecting the plate to one of the side walls of the forward portion of the body, the first pivot pin having a first diameter; and a second pivot pin pivotally connecting the plate to the other of the side walls of the forward portion of the body, the second pivot pin having a second diameter different from the first diameter.

7. The actuation device of claim 6, wherein the improvement further comprises:

a longitudinal shoulder located on each of the side walls of the forward portion so as to engage against the plate when the plate is in its second position.

8. An actuation device for holding a pressurized container and actuating a push button valve in the top of the container to dispense the pressurized contents thereof, the container having an annular channel around the valve, the device having a body including a forward portion adapted for removable attachment to the container, an actuation member in the forward portion of the body and having a first end engageable with the push button valve for actuation of the valve, user operable means for bringing the first end of the actuation member into operable engagement with the valve, and actuation member locking means operatively connected to the forward portion of the body and selectively movable between a first position allowing the operative engagement of the actuation member first end against the valve and a second position that locks the actuation member first end in a disengaged position from the valve, wherein the improvement comprises:

a substantially annular rim on the forward portion of the body, the rim being dimensioned to be removably received in the channel surrounding the valve, the rim being divided into first and second substantially semicircular halves joined at front and back junctures forming front and back rim portions, respectively, each of the rim halves having a side wall portion;

a reduced-thickness area in each of the side wall portions, the reduced-thickness areas forming flexure points at which the rim is resiliently flexible in response to forces applied to the front portion of the rim when the rim is inserted into the channel, front portion first; and a pin-and-socket assembly in the front portion of the rim, the pin-and-socket assembly comprising:

a pin extending from the first rim half toward the second rim half; and a socket in the second rim half, dimensioned to receive the pin.

9. The actuation device of claim 8, wherein the pin-and-socket assembly limits substantial relative movement between the rim halves as the rim is inserted into the channel.

10. The actuation device of claim 8, wherein the improvement further comprises:

a laterally-extended planar surface on the free end of the actuation member, the planar surface being operatively engageable with the valve.

11. The actuation device of claim 10, wherein the planar surface is substantially circular.

12. The actuation device of claim 8, wherein the forward portion of the body has two opposed side walls, and wherein the device further comprises a plate having a portion pivotally connected to the forward portion of the body between the two opposed side walls thereof, the plate having a notch dimensioned to receive the free end of the actuation member, the plate being pivotable between a first position wherein it is out of the path of travel between the actuation member and the valve, and a second position wherein the free end of the actuation member is received in the notch so as to be restrained from moving into engagement with the valve, and wherein the improvement further comprises:

a first pivot pin pivotally connecting the plate to one of the side walls of the forward portion of the body, the first pivot pin having a first diameter; and a second pivot pin pivotally connecting the plate to the other of the side walls of the forward portion of the body, the second pivot pin having a second diameter different from the first diameter.

13. The actuation device of claim 12, wherein the improvement further comprises:

a longitudinal shoulder located on each of the side walls of the forward portion so as to engage against the plate when the plate is in its second position.

* * * * *